US011557847B2

(12) United States Patent
Zebhauser et al.

(10) Patent No.: US 11,557,847 B2
(45) Date of Patent: Jan. 17, 2023

(54) SECURING SYSTEM FOR PLUG CONNECTORS

(71) Applicant: Rosenberger Hochfrequenztechnik GmbH & Co. KG, Fridolfing (DE)

(72) Inventors: Martin Zebhauser, Laufen (DE); Paul Schroeder, Laufen (DE); Markus Henning, Arnstadt (DE); Stefan Loeffelholz, Lorsch (DE)

(73) Assignee: Rosenburger Hochfrequenztechnik GmbH & Co. KG, Fridolfing (DE)

( * ) Notice: Subject to any disclaimer, the term of this patent is extended or adjusted under 35 U.S.C. 154(b) by 81 days.

(21) Appl. No.: 16/972,737

(22) PCT Filed: May 21, 2019

(86) PCT No.: PCT/EP2019/063099
§ 371 (c)(1),
(2) Date: Dec. 7, 2020

(87) PCT Pub. No.: WO2019/233763
PCT Pub. Date: Dec. 12, 2019

(65) Prior Publication Data

US 2021/0265763 A1 Aug. 26, 2021

(30) Foreign Application Priority Data

Jun. 5, 2018 (DE) ..... 10 2018 113 368.5

(51) Int. Cl.
*H01R 13/436* (2006.01)
*H01R 13/518* (2006.01)
(Continued)

(52) U.S. Cl.
CPC ..... *H01R 13/4362* (2013.01); *H01R 13/518* (2013.01); *H01R 13/6272* (2013.01); *H01R 13/6456* (2013.01); *H01R 2201/26* (2013.01)

(58) Field of Classification Search
CPC ..... H01R 13/6272; H01R 13/645; H01R 13/4362; H01R 13/514; H01R 13/362;
(Continued)

(56) References Cited

U.S. PATENT DOCUMENTS 6,491,542 B1 12/2002 Zerebilov
7,258,493 B2 * 8/2007 Milette ..... B27N 3/007 385/55

(Continued)

FOREIGN PATENT DOCUMENTS

CN 101861682 A 10/2010
CN 105284014 A 1/2016

(Continued)

*Primary Examiner* — Jean F Duverne
(74) *Attorney, Agent, or Firm* — Donald S. Showalter, Esq.; Gray Robinson, P.A.

(57) ABSTRACT

Embodiments of a securing system for plug connectors may have an adapter and a pair of housing parts, each with at least one plug place with a plug place interface for receiving the adapter whose exterior may have an adapter interface for positioning in the plug space. The adapter may have an interior geometry for receiving a plug connector. The exterior of the adapter and the plug place may form a primary securing means for securing the adapter in the respective plug place when the adapter is inserted into a defined plug position to secure the adapter in the plug place. Embodiments may include a secondary securing means, which can be plugged into the housing part up to a defined end position at which the secondary securing device to secure the plug connector in the adapter.

28 Claims, 6 Drawing Sheets

(51) Int. Cl.
*H01R 13/627* (2006.01)
*H01R 13/645* (2006.01)

(58) Field of Classification Search
CPC .. H01R 13/6456; H01R 13/518; H01R 31/06; H01R 2201/26
See application file for complete search history.

(56) References Cited

U.S. PATENT DOCUMENTS

| | | | | |
|---|---|---|---|---|
| 9,608,374 | B2 | 3/2017 | Beischer et al. | |
| 9,722,348 | B2 | 8/2017 | Zebhauser et al. | |
| 11,223,163 | B2 * | 1/2022 | Becavin ..... | H01R 31/06 |
| 2017/0222356 | A1 * | 8/2017 | Hashimoto ..... | H01R 13/14 |

FOREIGN PATENT DOCUMENTS

| | | | |
|---|---|---|---|
| CN | 105308799 | A | 2/2016 |
| CN | 105609992 | A | 5/2016 |
| EP | 3 021 422 | A1 | 5/2016 |
| WO | 2009/064484 | A1 | 5/2009 |

* cited by examiner

SECURING SYSTEM FOR PLUG CONNECTORS

CROSS REFERENCE TO RELATED APPLICATIONS

This is a U.S. National Phase Entry under 35 U.S.C. § 371 of International Application No. PCT/EP2019/063099 filed May 21, 2019 entitled: SECURING SYSTEM FOR PLUG CONNECTORS which designates the United States and at least one other country in addition to the United States and claims priority to German Patent Application No. 10 2018 113 368.5 filed Jun. 5, 2018.

STATEMENT REGARDING FEDERALLY-SPONSORED RESEARCH OR DEVELOPMENT

Not applicable.

INCORPORATION BY REFERENCE

International Application No. PCT/EP2019/063099 and German Patent Application No. 10 2018 113 368.5 are each expressly incorporated herein by reference in their entireties to form part of the present disclosure.

FIELD OF INVENTION

The invention relates to a securing system for plug connectors. Another aspect of the invention relates to a modular plug connector system for use vehicles the modular plug connector system having a securing system for the plug connectors. Another aspect of the invention relates to secondary securing means for a securing system for plug connectors or for a modular plug connector system.

BACKGROUND

The fabrication of cables typically involves the conductors thereof being connected to a plug connector in order then, in a known manner, to be able to establish electrical connections with other cables or conductors which have corresponding plug connectors or mating plug connectors. A plug connector or mating plug connector may be a plug, a panel plug, a socket, a coupling or an adapter. The designation "plug connector" used in the context of the invention represents all variants.

Particularly plug connectors for the automotive industry or for vehicles have high demands placed on them in term is of their robustness and the security of the plug connections. A plug connection is thus at times required to withstand high loading, for example mechanical loading, and to remain closed in a defined manner such that the electrical connection is not unintentionally disconnected, for example during the operation of a vehicle. Guaranteeing the security is paramount particularly during the autonomous operation of vehicles and for assistance systems.

Furthermore, the number of plug connections to be installed in vehicles is constantly increasing, while the required plug connector systems are becoming ever more complex at the same time. What frequently occurs in practice here is that different types of plug connectors are integrated in a common module housing. A particular problem here is that the assembly of the different plug connector types to be integrated in a module housing can greatly vary in an application-specific manner, for example in dependence on the vehicle type. The personnel and economic outlay on design, production and assembly of the plug connector systems is therefore comparatively high, particularly for vehicles.

An object on which the present invention is based is that of providing an improved securing system for plug connectors received in an adapter.

A further object on which the present invention is based is that of providing an improved plug connector system for vehicles in which the plug connectors received in an adapter are reliably secured.

A further object on which the present invention is based is that of providing improved securing for a securing system for plug connectors or a modular plug connector system for vehicles.

BRIEF SUMMARY OF THE INVENTION

The securing system according to the invention for plug connectors comprises an adapter and a housing part having at least one plug place with interfaces for receiving the adapter. The adapter has interfaces on its outer side for positioning in the plug place of the housing part. The adapter further has an internal geometry for receiving a plug connector. The outer sides of the adapter and the plug place of the housing part are configured in such a way that they form a primary securing means for fastening the adapter in the plug place when the adapter is inserted into a predefined plug position in the plug place. According to the invention, to secure the adapter in the plug place there is provided a secondary securing means which can be plugged into the housing part up and into a predefined end position, wherein the secondary securing means is designed in the end position also to secure the plug connector in the adapter.

The securing system according to the invention makes it possible for an adapter, which itself receives a plug connector, to be able to be particularly reliably connected to a housing part. There is a high demand, particularly in the automotive sector, for plug connectors to be received into suitable adapters which for their part are themselves again plugged into a plug place in a housing part. There can be provision here for the housing part to have a plurality of different or identical plug places. It is of crucial importance that the adapter is fixed reliably and securely in the plug place. Furthermore, it is of particular importance that the plug connector is also reliably received in the adapter. This applies particularly if, as illustrated below, the securing system is used in the context of a modular plug connector system.

The securing system according to the invention solves a number of problems in a simple and advantageous manner. The securing system according to the invention has both a primary securing means and a secondary securing means, thereby achieving a particularly secure and reliable connection. Moreover, the secondary securing means secures not only the adapter in the plug place but at the same time also the plug connector in the adapter. By virtue of the fact that the secondary securing means secures the aforementioned components in the end position, it is also checked in a particularly advantageous manner by way of the secondary securing means whether the adapter is plugged into the housing part into the intended position (plug position) and whether the plug connector (contact) is situated in the intended position in the adapter. The secondary securing means thus verifies the correct positioning (seating) of the adapter in the housing or of the plug connector in the adapter and additionally secures the corresponding connections.

The secondary securing means preferably secures or fixes the adapter in the respective plug place in a force-fitting and/or form-fitting manner.

Preferably, there is also provision for the secondary securing means to secure or fix the plug connector in the adapter in a force-fitting and/or form-fitting manner.

The plug place in the housing part preferably takes the form of a chamber. The housing part preferably has a plurality of plug places or chambers.

It is advantageous if the adapter can be plugged into the housing part in a plug-in direction (A, B) and the secondary securing means can be plugged into the housing part in a plug-in direction (C) orthogonal thereto.

It has been shown that, by virtue of the fact that the secondary securing means is plugged into the housing part in a plug-in direction which runs orthogonally to the plug-in direction of the adapter into the housing part, particularly high forces can be taken up by the secondary securing means, in particular forces which act in or counter to the plug-in direction of the adapter into the housing part.

The secondary securing means is preferably plugged into the housing part orthogonally to the plug-in direction of the adapter. However, it is also possible for the secondary securing means to be plugged into the housing part at another angle relative to the plug-in direction of the adapter, for example also at an angle of up to five degrees (5°), up to ten degrees (10°), up to fifteen degrees (15°), or even up to forty five degrees (45°).

As mentioned at the outset, it is in particular on plug connector systems for vehicles that particularly high requirements are placed. It must also be ensured at times that, in spite of high mechanical loading, the opening of plug connections is avoided. A secondary securing means can thus be particularly advantageously suitable for holding the plug connections securely closed in each case and for observing or exceeding corresponding safety guidelines for vehicles.

The primary securing means according to the invention can particularly involve the adapter being secured in the housing part in a force-fitting and/or form-fitting manner.

The primary securing means is preferably designed as a form-fitting axial securing means to prevent extraction of the adapter counter to the plug-in direction when the adapter is inserted into its plug position.

There can be provision for the primary securing means to be released again as required, for example with the aid of a suitable means, for example a screwdriver. However, there can also be provision that the primary securing means can no longer be opened non-destructively after the corresponding adapter has been inserted into its plug position.

In one embodiment, there can be provision in particular for the secondary securing means to have a blocking element to block the primary securing means in its locking state.

For example, there can be provision for the blocking element to take the form of a dome-like elevation and/or a web in order to block or engage behind a spring arm of the primary securing means and to securely fix it in the corresponding latching nose or hold it in engagement with the latching nose in a form-fitting manner.

In one embodiment of the invention, there can additionally be provision for the secondary securing means to have a plug-in preventer, wherein the plug-in preventer is designed to prevent a connection between a plug connector and a corresponding plug connector or a mating plug connector when the secondary securing means is plugged, but not yet completely plugged into the housing part into the predefined end position.

It is thus possible for a user-side (inadvertent) plugging together of two adapters to be blocked if, for example, one of the adapters is not yet situated in a defined assembly position and/or is not yet sufficiently secured by the secondary securing means.

In one embodiment of the invention, there can be provision for the secondary securing means, the housing part and/or the adapter to be designed in such a way that the secondary securing means can assume at least two plug states, wherein one plug state relates to a pre-latching position in which the secondary securing means is connected to the adapter inside the housing part, and wherein a further plug state relates to the end position in which the secondary securing means is completely plugged into the housing part, wherein the secondary securing means fixes the plug connector in the adapter in this plug state.

The fact that the secondary securing means can assume at least two plug states makes it possible to realize various configurations. There can be provision for example for the secondary securing means to be positioned in the pre-latching position in such a way that the plug-in preventer prevents the plug connector from being plugged together with a corresponding further plug connector, that is to say that two plug connectors cannot yet be plugged together. This can be achieved for example by virtue of the plug-in preventer being situated in the plug-in path of the two corresponding plug connectors, with the result that they cannot be mechanically plugged together. Furthermore, there can be provision in the pre-latching position for the secondary securing means to at least check whether the adapter is situated in the intended position in the housing part. This can be achieved for example in that the secondary securing means cannot be mechanically plugged into the pre-latching position when the plug connector is not correctly positioned in the adapter. There can optionally be provision for the secondary securing means in the pre-latching position to be captively connected to the housing part or the adapter.

In one embodiment of the invention, there can additionally be provision for the secondary securing means, the housing part and/or the adapter to be designed in such a way that the secondary securing means can assume at least three plug states along its plug-in direction, wherein a first plug state relates to a basic position in which the secondary securing means is captively connected to the housing part but not yet to the adapter, and wherein a second plug state relates to a pre-latching position in which the secondary securing means is connected to the adapter inside the housing part, and wherein a third plug state relates to the end position in which the secondary securing means is completely plugged into the housing part, wherein the secondary securing means fixes the plug connector in the assigned adapter in the third plug state.

In a particularly advantageous manner, the secondary securing means is configured in such a way that it secures or fixes both the adapter in the assigned housing part and the plug connector in the respective adapter.

The secondary securing means can preferably take the form of a slide.

The fact that the secondary securing means in its basic position is captively connected to the housing part means that the secondary securing means can be advantageously delivered with the housing part and is immediately ready for use without delay during assembly. The secondary securing means can thus also not be lost during delivery or assembly.

The secondary securing means can preferably be designed in such a way that the plug-in preventer prevent two corresponding adapters or plug connectors from being plugged together when the secondary securing means is situated in the pre-latching position. It is already sufficient for this purpose if one of the adapters is provided with a secondary securing means which has a plug-in preventer.

It is advantageous if the secondary securing means in the end position is connected to the housing part in a form-fitting manner and to the adapter and/or the assigned plug connector in a form-fitting manner in order to channel axial forces acting on the plug connectors via the secondary securing means into the assigned housing part.

This configuration makes it possible in a particularly advantageous manner for axial forces acting on the plug connector in its plug-in/plug-out direction to be taken up by the housing part. The connection between the plug connector and the corresponding plug connector or a mating plug connector with which the plug connector is intended to be united is thus relieved of load.

The secondary securing means can have a securing clamp, a snap connection, a receptacle or a partially circular, preferably semicircular, spring element which in the end position embraces the plug connector inserted into the adapter in an at least partially form-fitting and/or force-fitting manner.

The plug connector preferably has a suitable groove, an annular depression or a recess, into which the securing clamp, the snap connection, the receptacle or the spring element penetrates, preferably in a form-fitting manner.

According to the invention, there can be provision for the secondary securing means to have a latching element which in the end position latches in a form-fitting manner with a latching receptacle in the adapter to prevent a movement of the secondary securing means counter to the plug-in direction.

The formation of a latching element and a latching receptacle allows the secondary securing means to be fixed to the adapter and thus also in the housing part in a simple manner, with the result that the secondary securing means is reliably held in the end position.

In one embodiment, the latching element can be formed on at least one free end of the securing clamp, of the receptacle, of the snap connection or of the spring element. In the end position of the secondary securing means, the latching element latches with the adapter, preferably in latching receptacles formed therein, for example in a depression, a shoulder or a groove. This is preferably intended to result in a form-fitting engagement in the pull-out direction or counter to the plug-in direction.

The latching element or elements of the secondary securing means are preferably designed as snap hooks. There can be provision for the secondary securing means to have two or more latching elements designed in such a way. It is preferable, however, that only one snap hook is provided and correspondingly one latching receptacle is formed in the adapter with which the snap hook can latch in the end position of the secondary securing means. This has proved to be particularly suitable for reliably securing the secondary securing means in the adapter but at the same time for making it possible, with simple measures, for example a corresponding tool, preferably a special tool, to release the secondary securing means from the adapter by releasing the latching element from its latching position in the adapter again.

The secondary securing means is preferably designed in such a way that it can be plugged into the end position only when the plug connector is positioned correctly, or in its plug position (end position), in the respective adapter. This can preferably be achieved in that the securing clamp is configured in such a way that it has, for example, to strike an annular depression of the plug connector in order to be able to embrace the plug connector.

In one embodiment, there can be provision for the plug connector to be designed as a plug, coupling, socket, printed circuit board plug connector and/or housing plug connector, in particular of the HFM, H-MTD, AMEC, PL, BNC, TNC, SMBA, SMA, SMB, SMS, SMC, SMP, BMS, HSD, BMK, Mini-Coax and/or Makax type.

This list is of course not limiting. In principle, the invention can be realized with any desired plug connector types. In particular, the invention is suitable for plug connectors typically used in the automotive industry, and in particular also for plug connectors for high-frequency technology.

In one embodiment of the invention, there can be provision in particular for the plug place and the adapter to form a guide for guiding the adapter into the plug place.

The guide can preferably be formed by the plug place having guide webs which, in combination with corresponding guide elements, for example grooves or further guide webs of the adapter, form a rail system or some other positive guide for the plug-in movement. Alternatively, the adapter can also have guide webs and the plug place can correspondingly have correspondingly formed guide elements, for example grooves.

The plug-in movement can be particularly comfortable as a result. It is possible in particular to avoid jamming of, and, resulting therefrom, possible damage to, the components during plugging-in.

There can be provision that a plug place is designed for receiving a plurality of adapters and hence plug connectors. The plug place can have correspondingly formed guide webs and/or rail systems in order, where appropriate, also only selectively to receive a plurality of adapters.

In one embodiment, there can additionally be provision for the plug place to have an axial end stop.

The end stop can be provided on the inner side of the plug place or on the outer side of the plug place and correspondingly interact with the corresponding adapter. There can also be provision for the adapter to have an end stop which, with an adapter plugged into its plug position, butts against the outer side of the housing part or against some other point of the housing part provided therefor.

The end stop can preferably be arranged on an end of a guide web or on an end of the rail system of the plug place.

In an advantageous embodiment of the invention, there can be provision for the primary securing means to be formed by at least one latching nose and a spring arm.

In principle, there can be provided any desired latching means which comprise one or more latching noses, spring arms, snap hooks, snap receptacles, latching hooks, etc.

The corresponding adapter can, as required, preferably be able to be removed non-destructively again from the plug place.

In one embodiment, there can additionally be provision for the adapter and the plug place to be configured in such a way that plugging-in of the adapter is possible in only one predetermined orientation.

The adapter and the plug place can have a polarization in order for example to block an adapter being plugged into a plug place by being rotated through one hundred eighty degrees (180°) or otherwise rotated. For this purpose, the adapter and/or the plug place can be correspondingly mechanically or geometrically configured, for example using asymmetrical structures, in particular chamfers or bevels. It is also possible for magnetic codings or anti-rotational safeguards to be provided, for example by means of a corresponding arrangement and distribution of magnetic poles of permanent magnets on the adapter and the plug place.

In one embodiment, there can further be provision for mechanical codings to be provided on an end side of the adapter that is at the front in the plug-in direction and/or on a front end of a plug place of the housing part in such a way that only pairs of plug connectors which are functionally assigned to one another and/or which correspond to the same plug type can be connected to one another.

It is thus possible in particular also for corresponding plug connectors of the same type to be connected to one another only when they are functionally assigned to one another. This makes it possible for example to avoid mixing up a control line of a right indicator of a motor vehicle with the control line of a left indicator. This is particularly advantageous when the housing part has a plurality of plug places or the securing system is realized in a modular plug connector system.

Furthermore, the configuration can also achieve a situation, or support bringing about a situation, in which plug types which do not correspond to the same type cannot be connected to one another.

The modular plug connector system according to the invention for vehicles as claimed in claim 18 comprises a module housing having a first housing part having a plurality of uniform plug places with interfaces for respectively receiving a first adapter from a first adapter group, wherein the first adapter group comprises a plurality of first adapters of different type which have uniform interfaces on their outer sides for positioning in the plug places of the first housing part, and which have a different internal geometry for receiving differently configured plug connectors. The outer sides of the first adapters and the plug places of the first housing part are configured in such a way that they form a primary securing means for fastening the first adapter in the respective plug place when the first adapter is inserted into a predefined plug position in the plug place. According to the invention, the module housing further comprises a second housing part having a plurality of uniform plug places with interfaces for respectively receiving a second adapter from a second adapter group, wherein the second adapter group comprises a plurality of second adapters of different type which have uniform interfaces on their outer sides for positioning in the plug places of the second housing part. The outer sides of the second adapters and the plug places of the second housing part are configured in such a way that they form a primary securing means for fastening the second adapter in the respective plug place when the second adapter is inserted into a predefined plug position in the plug place.

According to the invention, a securing system having secondary securing means is provided, wherein the secondary securing means can be plugged into the housing parts up and into a predefined end position, and wherein the secondary securing means are designed in the end position to secure the first adapters and/or the second adapters in the respective plug places, and the secondary securing means are further designed to secure the plug connectors in the first adapters and/or to secure the mating plug connectors in the second adapters.

The modular plug connector system described is advantageously suitable for use in a vehicle since the requirements—in particular with regard to weight, size and number of different plug connector types to be used—in a vehicle are particularly high.

In the present case, the term "vehicle" describes any means of propulsion, in particular land vehicles, watercraft or aircraft, also including spacecraft. However, the invention is very particularly suitable for use in motor vehicles.

For the purposes of the invention relating to the modular plug connection system, a "uniform plug place" is to be understood in particular as meaning a functional uniform plug place which can be used for the universal reception of the adapter types provided in the corresponding adapter group. For this purpose, the geometrical and, where appropriate, electrical configuration of the different plug places does not necessarily have to be completely identical; however, this is preferably the case.

The plug places preferably take the form of chambers.

The adapters serve to make usable any desired types of plug connectors or mating plug connectors for the modular plug connector system. For this purpose, the plug connectors or mating plug connectors can be plugged into an adapter of a suitable type.

A plug connector or mating plug connector can also be an individual (or a plurality of) fabricated contact(s).

It is a particular advantage of the invention that a plug connector system for vehicles can now be used in a modular manner, thereby making it possible to considerably simplify the plug connector system in terms of the design effort, production outlay and assembly effort. For example, there can be provision to use the plug connector system according to the invention across vehicle models. Here, the module housing can always be the same. During assembly, it may be merely required to select the correspondingly suited adapters from a prepared number of adapters for receiving the plug connectors or mating plug connectors and to virtually freely combine them in the module housing using any desired plug places.

The plug places can take the form of cavities or chambers which have a functionally identical geometrical configuration in order to receive the different types of adapters, which, however, have uniform interfaces for positioning, in particular for fastening.

Preferably, all the plug places for the first adapter group are of identical design. Preferably, all the plug places for the second adapter group are of identical design. Preferably, the plug places for the first adapter group and the plug places for the second adapter group are not of identical design.

It is particularly preferable for all the plug places of the first housing part to be of identical design. It is particularly preferable for all the plug places of the second housing part to be of identical design. Preferably, the plug places of the first housing part and the plug places of the second housing part are not of identical design.

There can be provision that an adapter and hence plug connector or mating plug connector of any desired type of the first or second adapter group can be plugged into each plug place by virtue of the adapters being configured with a functionally identical external geometry and having an internal geometry which is designed for receiving the respective plug connector or mating plug connector.

A modular system of different adapters for integrating any desired plug connectors or mating plug connectors into the plug connector system can be provided.

The first adapters have, according to the invention, uniform interfaces on their outer sides for positioning, in particular for fastening and/or for inserting into the plug places of the first housing part. Interfaces for positioning which apply are in particular interfaces for fastening, for inserting, for low-play positioning or orienting in the plug position and for receiving a uniform secondary securing means. The adapters are preferably configured in such a way that they form at least one, preferably a plurality of, particularly preferably all, interface(s) stated below. There is preferably provided an interface for forming the primary securing means, an interface for receiving a secondary securing means, an interface for inserting/guiding the adapter to position it in the plug place, an interface which is suitable to form an end stop with the plug place, and an interface to realize as low-play positioning as possible in the plug position (assembly position) in the plug place, wherein, for low-play positioning, preferably the external geometry of the first adapter is correspondingly configured.

The second adapter preferably has an analogous design of its interfaces with the plug places of the second housing part.

The fact that the first adapter group comprises a plurality of first adapters of different type does not mean in all alternatives that each of the first adapters is differently configured. Within the scope of the invention relating to the modular plug connector system, it is sufficient if at least two of the first adapters of the first adapter group are configured differently from one another, that is to say at least two different types of plug connectors can be received by the first adapters of the first adapter group. The same also applies to the second adapters of the second adapter group.

The securing system provided in the modular plug connector system according to the invention and having a plurality of secondary securing means is preferably designed in such a way as has been described with respect to the securing system according to the invention for plug connectors.

The securing system according to the invention for plug connectors discloses advantageous securing in a housing part of a plug connector received in an adapter.

The modular plug connector system provided according to the invention comprises a module housing having a first housing part and a second housing part which each have a plurality of plug places for receiving (first and second) adapters. The securing system according to the invention for plug connectors can be used in a particularly advantageous manner in such a modular plug connector system.

Insofar as reference is made in the context of the securing system for plug connectors to a plug connector or an adapter, this is to be correspondingly understood in the context of the modular plug connector system as meaning both a plug connector and a mating plug connector or a first adapter and a second adapter, respectively.

The securing system according to the invention for the modular plug connector system having the plurality of secondary securing means makes it possible for the adapters plugged into the housing parts to be secured in a particularly advantageous manner. For this purpose, there is provision for the secondary securing means to be plugged into the housing parts up and into a predefined end position. Here, the secondary securing means are designed in the end position to secure the first adapters and/or the second adapters in the respective plug places. It is also possible for only some of the first adapters and/or second adapters to be correspondingly secured. Furthermore, the secondary securing means are designed for securing the plug connectors in the first adapters and/or for securing the mating plug connectors in the second adapters. It is also possible for only some of the plug connectors or mating plug connectors to be secured in the corresponding adapters.

In one embodiment of the invention, there can be provision that the first housing part can be connected to the second housing part in order to connect the plug connectors received in the first housing part to the corresponding mating plug connectors received in the second housing part.

The connection of the housing parts for connecting the plug connectors to the mating plug connectors can be advantageous since then, during assembly, it is not necessary for each connection between plug connector and mating plug connector to be established individually. This can be particularly advantageous when many plug connections are present within the plug connector system.

There can be provision here in particular for an electrical connection between the plug connectors and the corresponding mating plug connectors in order to provide a suitable signal transmission. A mechanical connection between the plug connectors and the corresponding mating plug connectors, for example using their usual connecting and/or latching means, can also be advantageous.

In principle, when there is a connection between the plug connectors and the corresponding mating plug connectors, there can also be provision for the first adapters in which the plug connectors are received and for the second adapters in which the mating plug connectors are received to be electrically and/or mechanically connected to one another in order to establish an indirect electrical and/or mechanical connection between the plug connectors and mating plug connectors.

In principle, it is noted that a "first housing part" and a "second housing part" can be understood to mean two separate housing parts as well as a purely functional division of the module housing. The housing parts can therefore thus be also fixedly connected to one another or even formed in one piece.

However, the multipart design of the module housing can be particularly advantageous, whereby the first housing part can be connected to the second housing part.

In one embodiment, there can be provision in particular for the housing parts to be designed to securely channel away mechanical loads which act on the plug connectors and the mating plug connectors and/or to ensure the holding force between the plug connectors and the mating plug connectors.

In particular, the housing parts can be designed in such a way as to be able to take up undesired shear forces and/or tensile forces. This has the advantage that the adapters and/or the plug connectors or mating plug connectors themselves do not necessarily have to be configured to withstand such mechanical loads. It is thus possible for the known plug connectors or mating plug connectors to have, where appropriate, a more material-saving design and, moreover, types of plug connectors or mating plug connectors can be used which typically are unsuitable for use in vehicles owing to a lack of robustness.

In one embodiment of the invention, there can be provision that the housing parts can be plugged one inside the other and can be latched with one another via at least one latching element pair.

Alternatively or additionally, however, there can also be provision that latching between the housing parts is achieved by corresponding latching means of the adapters and/or by latching means between the plug connectors and mating plug connectors.

There can also be provision for the housing parts to be mechanically coded and/or polarized such that only housing parts of the same module housing type can be plugged together and/or can be plugged in only in a defined orientation.

In one embodiment of the invention, there can additionally be provision for the housing parts each to have one, two or more rows of plug places arranged parallel to or offset from one another.

Particularly if the housing parts have more than two rows of plug places, for example three rows, an offset arrangement can be advantageous in order to ensure accessibility to the individual plug places from an upper side and/or an underside of the module housing, for example to plug in the secondary securing means, to ensure access to the individual primary securing means and/or to provide a viewing opening for an optical visual inspection of the plug connection.

In one embodiment of the invention, there can be provision for the first adapters, the second adapters and the two housing parts to be configured in such a way that the first adapters can be plugged only into the plug places of the first housing part, and the second adapters can be plugged only into the plug places of the second housing part.

For example, there can be provision that only plugs or "male plug connectors" can be plugged into the plug places of the first housing part and only couplings or "female plug connectors" can be plugged into the plug places of the second housing part. This can preferably occur by means of corresponding mechanical codings or geometrical configurations of the corresponding plug places and adapters. A magnetic coding can also be provided.

According to an advantageous embodiment, a corresponding secondary securing means can be provided for each adapter type of the two adapter groups.

In particular, there can be provision for the secondary securing means to be adapted for securing the plug connector or the mating plug connector inside the corresponding adapters.

The invention also relates to a secondary securing means for a securing system for plug connectors and/or for a modular plug connector system having one or more of the aforementioned features of the securing system for plug connectors or of the modular plug connector system.

Here, the secondary securing means according to the invention can have one of the features or a plurality of the features which have been stated above with respect to the secondary securing means and which in particular have the effect that the secondary securing means secures the adapter in the housing part in the predefined end position, for which purpose the secondary securing means can be plugged into the housing part. In particular, there can be provision that the secondary securing means in the end position also secures the plug connector in the adapter and is correspondingly designed for this purpose, as described above.

The secondary securing means can in particular also have the features which are mentioned in the claim version with respect to the secondary securing means, with it being possible for the features mentioned therein to be combined with one another as desired.

The secondary securing means can in particular be designed to secure the primary securing means and/or to secure the correct seating of the adapter in the housing part and/or to secure the plug connector in the adapter. Further advantageous configurations will also emerge from the above description and that which follows, in particular also from the descriptions of the figures and from the drawings.

Features which have already been described in conjunction with the securing system according to the invention for plug connectors can of course also be correspondingly applied to the modular plug connector system or the secondary securing means, and vice versa. Furthermore, advantages which have already been stated in conjunction with the securing system according to the invention for plug connectors can also be understood as relating to the modular plug connector system or the secondary securing means, and vice versa.

It is noted that expressions such as "comprising", "having" or "with" do not exclude any other features or steps. Furthermore, expressions such as "a", "an" or "the" which refer to a single number of steps or features do not exclude a plurality of features or steps, and vice versa.

Exemplary embodiments of the invention will be described in greater detail below with reference to the drawings In an exemplary embodiment there is described a modular plug connector system which has the securing system likewise according to the invention.

The description of the exemplary embodiment is in particular to be understood in such a way that it also serves to illustrate how a securing system can be realized for only one plug connector. The exemplary embodiment is in particular to be understood in such a way that a securing system for a plug connector can also be realized if only one housing part with only one plug place (or a plurality of plug places) is present. In order to realize the securing system according to the invention for a plug connector, it is in particular not necessary to form different adapter groups. To realize the securing system for a plug connector, only the features which are specified in the claims are necessary. All other features, in particular the features which are presented with respect to the modular plug connector system in the exemplary embodiment which follows, are optional for the securing system for plug connectors.

The figures show a preferred exemplary embodiment in which individual features of the present invention are illustrated in combination with one another. However, the features of the exemplary embodiment can also be implemented in isolation from the other features of the exemplary embodiment and can accordingly be readily combined by a person skilled in the art to form further expedient combinations and sub-combinations.

BRIEF DESCRIPTION OF THE DRAWINGS

Functionally identical elements are provided with the same reference signs in the figures, in which.

DETAILED DESCRIPTION OF PREFERRED EMBODIMENTS

Figure 1:
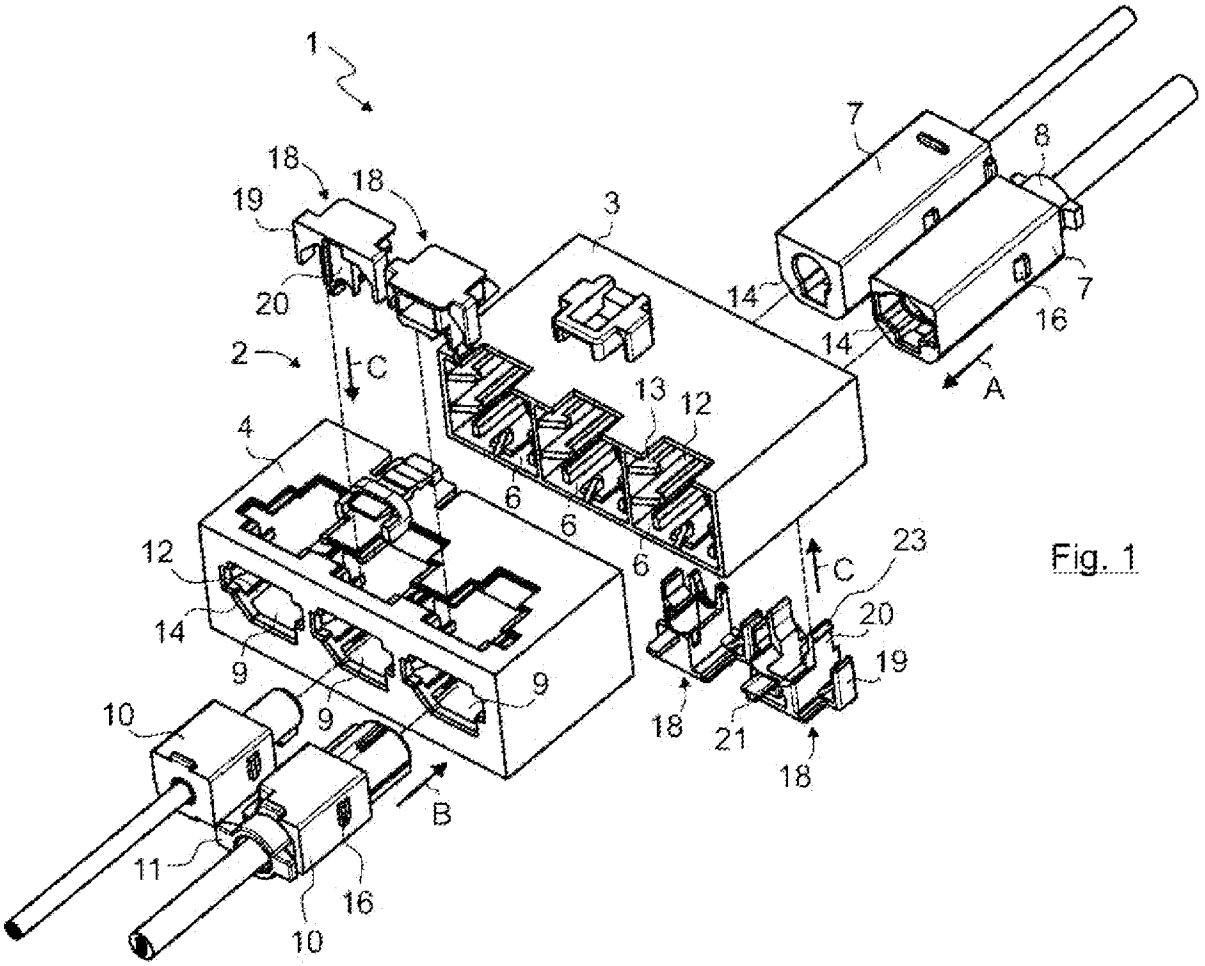
FIG. 1 schematically shows the modular plug connector system in the unassembled state in the manner of an exploded illustration in isometric view.
Figure 2:
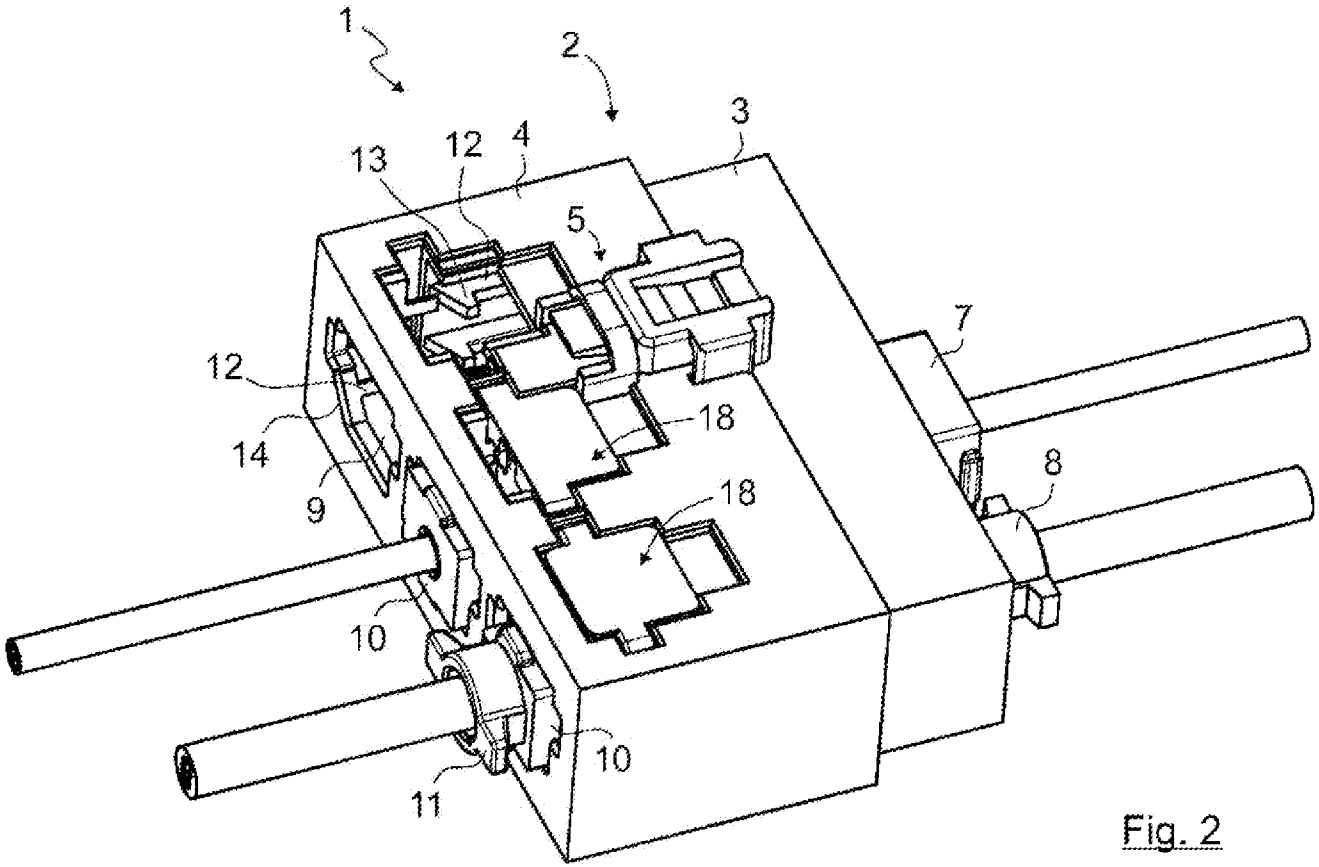
FIG. 2 schematically shows the modular plug connector system in the assembled state in an isometric view.

The exemplary embodiment shows the modular plug connector system 1 according to the invention for vehicles. FIG. 1 illustrates an unassembled state and FIG. 2 illustrates an assembled state.

The plug connector system 1 comprises a module housing 2 having a first housing part 3 and having a second housing part 4. The housing parts 3, 4 can be plugged one inside the other and can be latched with one another via a latching element pair 5 (cf. FIG. 2). In principle, however, the module housing 2 can also be formed in one piece. Furthermore, the latching element pair 5 can be formed at any desired point and in any desired embodiment, be multiply present or be omitted.

The first housing part 3 comprises a plurality of uniform plug places 6 with interfaces for respectively receiving a first adapter 7 from a first adapter group, wherein the first adapter group comprises a plurality of first adapters 7 of different type which have uniform interfaces on their outer sides for positioning, in particular for fastening, in the plug places 6 of the first housing part 3, and which have a different internal geometry for receiving differently configured plug connectors 8. Analogously, the second housing part 4 comprises a plurality of uniform plug places 9 with interfaces for respectively receiving a second adapter 10 from a second adapter group, wherein the second adapter group comprises a plurality of second adapters 10 of different type which have uniform interfaces on their outer sides for positioning, in particular for fastening, in the plug places 9 of the second housing part 4, and which have a different internal geometry for receiving differently configured mating plug connectors 11.

In principle, there can be provision for the housing parts 3, 4 to each have one (as realized in the exemplary embodiment), two, three or even more rows of plug places 6, 9 arranged parallel to or offset from one another. However, the exact number of plug places 6, 9 used and the arrangement or distribution thereof within the module housing 2 is of no importance for the purposes of the invention.

In the exemplary embodiment, the first housing part 3 can be connected to the second housing part 4 in order to connect the plug connectors 8 received in the first housing part 3 to the corresponding mating plug connectors 11 received in the second housing part 4. What is of essential importance here is the establishment of an electrical connection between the plug connectors 8 and the mating plug connectors 11.

Particularly if the module housing 2 is formed in one piece, there can also be provision that the first adapters 7, together with the plug connectors 8 received therein, can be plugged directly into the functionally defined first housing part 3 of the module housing 2 and are connected to the corresponding mating plug connectors 11 when the second adapters 10, together with the mating plug connectors 11 received therein, are plugged into the functionally defined second housing part 4 of the module housing 2.

The housing parts 3, 4 are preferably designed to securely channel away mechanical loads which act on the plug connectors 8 and the mating plug connectors 11 and/or to ensure the holding force between the plug connectors 8 and the mating plug connectors 11. It is accordingly the case that, inter alia, undesired shear forces are channelled away by the robust module housing 2, and the plug connectors 8 or the mating plug connectors 11 are less strongly loaded.

In principle, the plug connectors 8 and the mating plug connectors 11 can take the form of plugs, couplings, sockets, printed circuit board plug connectors and/or housing plug connectors. For example, plug connectors 8 or mating plug connectors 11 of the HFM, H-MTD, AMEC, PL, BNC, TNC, SMBA, SMA, SMB, SMS, SMC, SMP, BMS, HSD, BMK, Mini-Coax and/or Makax types can be used. The invention is not limited to a certain type of plug connector 8 or mating plug connector 11.

Figure 5:
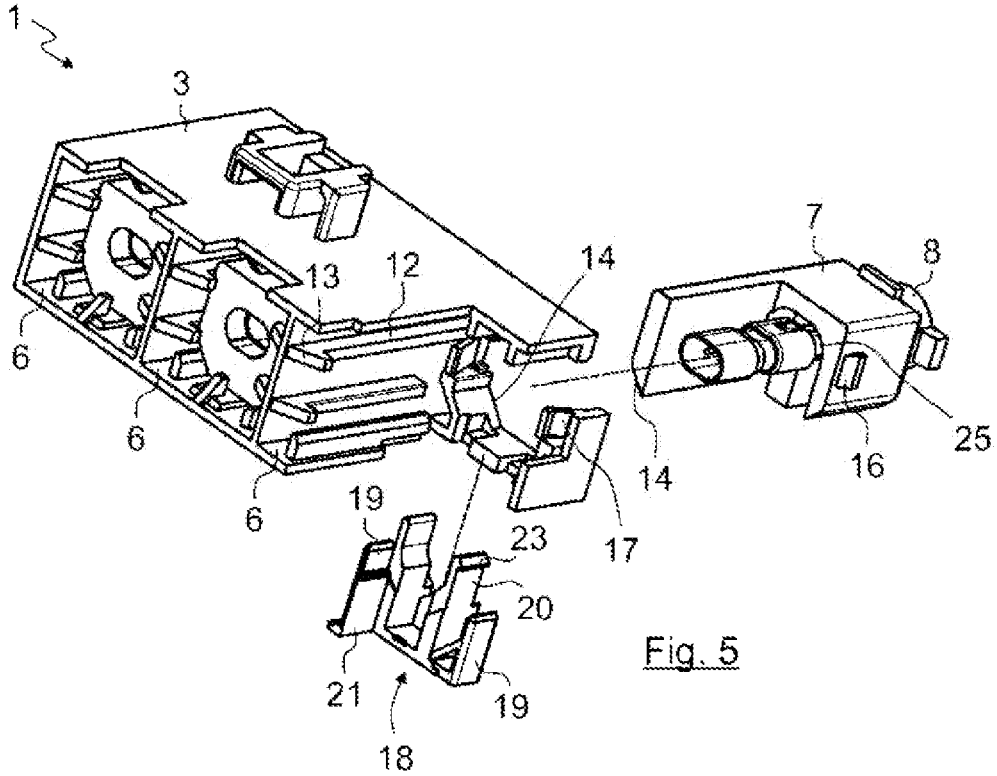
FIG. 5 schematically shows an isometric, partially sectioned view of the first housing part of the unassembled plug connector system.

In the exemplary embodiment, the plug places 6, 9 and the adapters 7, 10 form guides 12. In the exemplary embodiment, the guides take the form of guide webs 12 of the plug places 6, 9 and corresponding guide elements (not illustrated in further detail) of the adapters 7, 10. The guide webs 12 serve to receive the adapters 7, 10. Furthermore, the plug places 6, 9 comprise axial end stops 13 (cf. in particular FIG. 1 and FIGS. 5 and 6).

Figure 3:
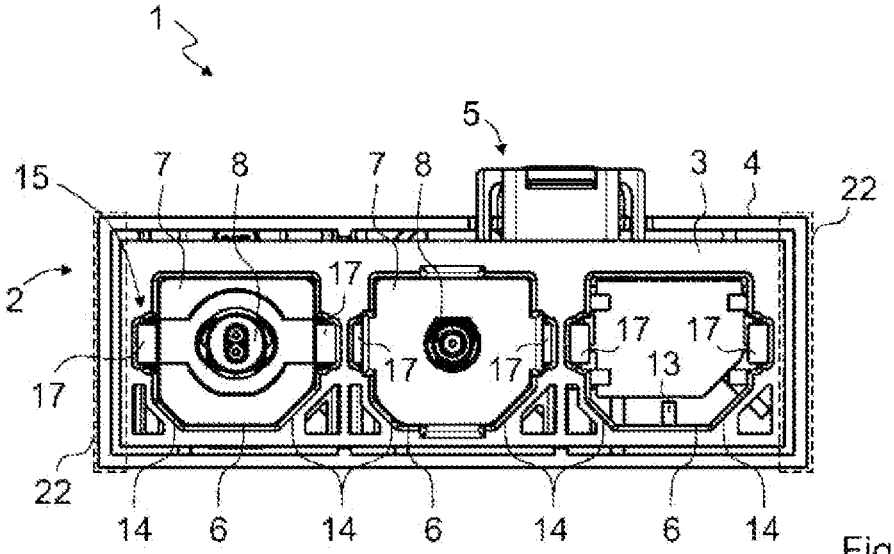
FIG. 3 schematically shows the assembled plug connector system of FIG. 2 in a front view of the first housing part.
Figure 4:
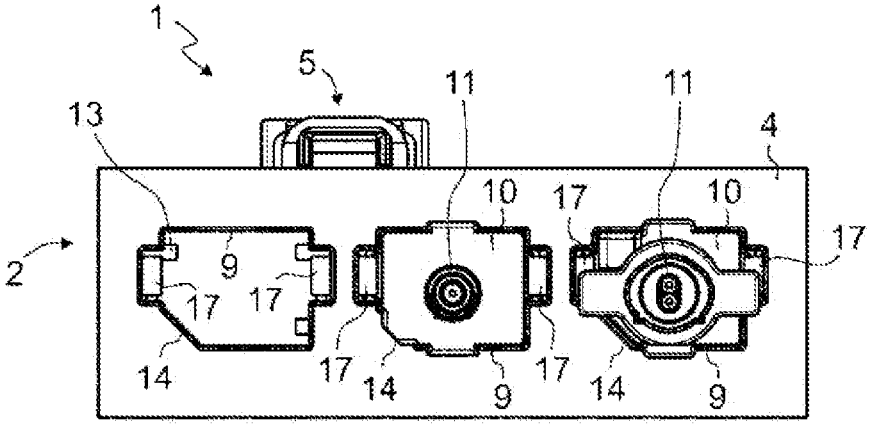
FIG. 4 schematically shows the assembled plug connector system of FIG. 2 in a front view of the second housing part.

It is furthermore possible for the adapters 7, 10 and the plug places 6, 9 to be configured in such a way that plugging-in of the adapters 7, 10 is possible in only one predetermined orientation. It is possible here particularly to avoid plugging-in with the wrong polarity, for example plugging-in with a rotation through one hundred eighty degrees (180°). The anti-rotational safeguarding is achieved in the exemplary embodiment by a mechanical coding which is realized by an asymmetrical geometrical configuration of the insertion openings in the plug places 6, 9 and by a corresponding external configuration of the adapters 7, 10. This can be seen in particular in FIGS. 3 and 4, which show a front view of the first housing part 3 (FIG. 3) and of the second housing part 4 (FIG. 4). The mechanical coding serving for this purpose is in particular in the form of differently configured bevels 14.

Furthermore, the first adapters 7, the second adapters 10 and the two housing parts 3, 4 are configured in such a way that the first adapters 7 can be plugged only into the plug places 6 of the first housing part 3, and the second adapters 10 can be plugged only into the plug places 9 of the second housing part 4. Also provided for this purpose is a corresponding mechanical coding which is realized by means of a corresponding geometrical configuration of the components using projections, recesses and/or bevels 14.

Furthermore, there can be provision that mechanical codings are provided on the end sides of the adapters 7, 10 that are at the front in the plug-in direction A, B (cf. FIG. 1) and/or on a front end of a plug place 6, 9 of the housing parts 3, 4 in such a way that only pairs of plug connectors 8 and mating plug connectors 11 which are functionally assigned to one another can be connected.

Furthermore, there is provision in the exemplary embodiment that the outer sides of the first adapters 7 and the outer sides of the second adapters 10 and also the plug places 6 of the first housing part 3 and the plug places 9 of the second housing part 4 are configured in such a way that they form a primary securing means 15 (cf. FIGS. 6-9) for fastening the respective adapter 7, 10 in the corresponding plug place 6, 9 when the respective adapter 7, 10 is inserted into its plug position in the corresponding plug place 6, 9.

Figure 6:
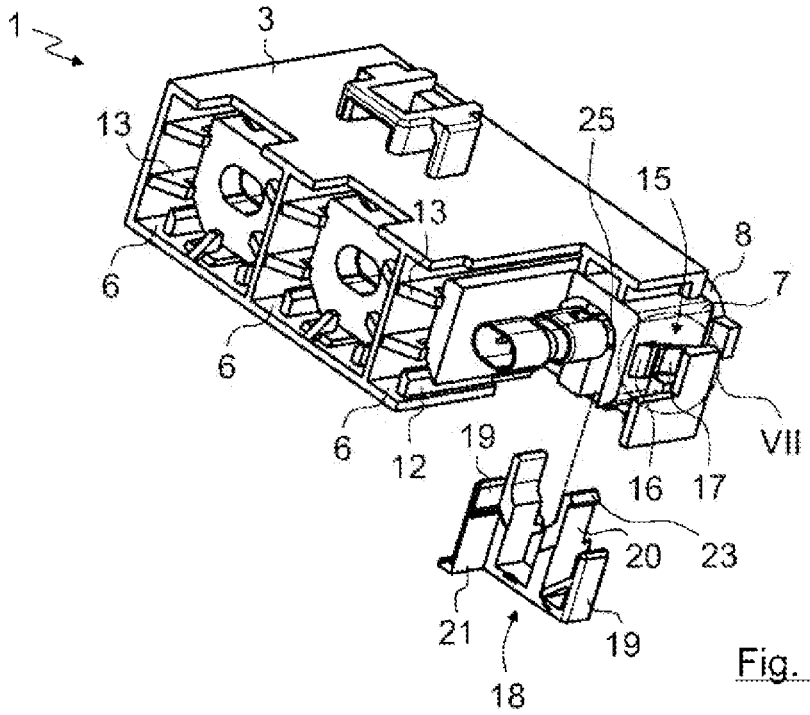
FIG. 6 schematically shows the illustration of the plug connector system as shown in FIG. 5 during a first assembly step.
Figure 7:
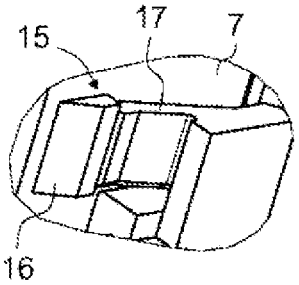
FIG. 7 schematically shows an enlarged illustration of the detail VII of FIG. 6.

In particular, there can be provision that the primary securing means 15 is formed by at least one latching nose 16 and a spring arm 17, as illustrated for example in FIG. 6 and the corresponding enlargement as shown in FIG. 7. The primary securing means preferably has two pairs of latching noses 16/spring aims 17 which fix the adapter 7, 10 on opposite sides in the respective plug place 6, 9.

The plug connector system 1 has secondary securing means 18 for securing the adapters 7, 10 in the respective plug places 6, 9 that can be plugged along a plug-in direction C orthogonally to the plug-in direction A, B of the adapters 7, 10 into the housing parts 3, 4 up and into a predefined end position. The end positions can be seen in particular in FIGS. 2 and 8 or 9.

Figure 8:
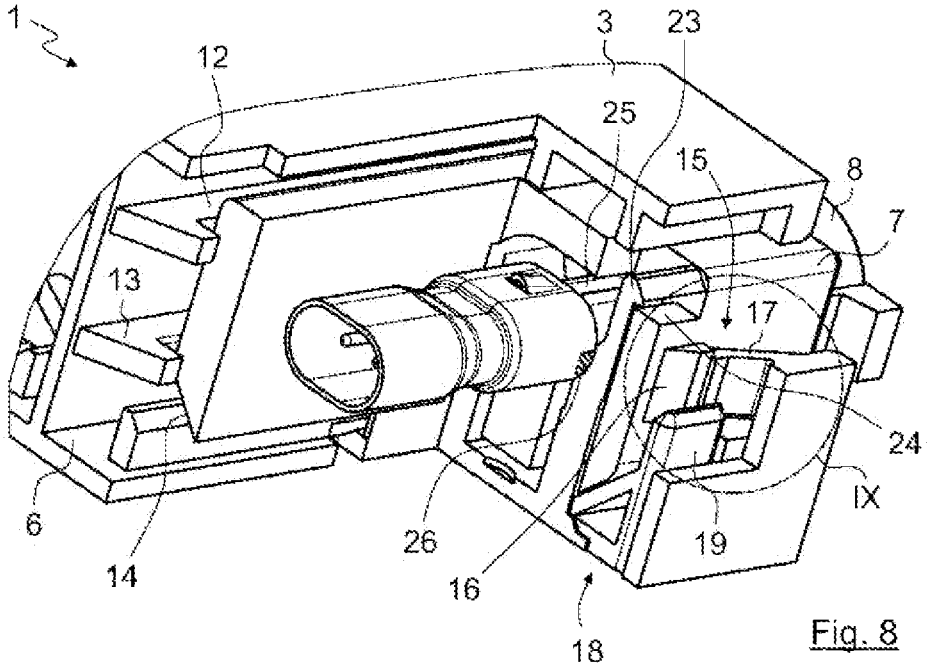
FIG. 8 schematically shows the enlarged-detail illustration of the plug connector system as shown in FIG. 5 during a second assembly step.
Figure 9:
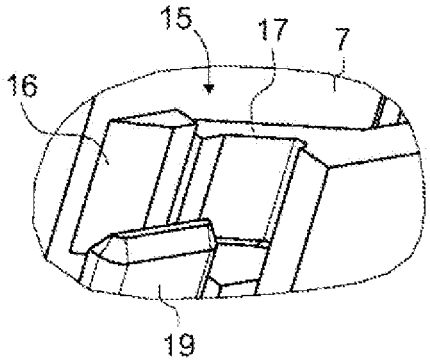
FIG. 9 schematically shows an enlarged illustration of the detail IX of FIG. 8.

In particular, the secondary securing means 18 can have blocking elements 19 in order to block the primary securing means 15 in their blocking state, for example by engaging behind the spring arms 17 in order to block them in the latching noses 16 in a form-fitting manner, as is clearly evident in FIG. 8 and the enlargement as shown in FIG. 9.

The blocking elements 19 prevent a situation in which the spring aims 17 can spring back into a position which releases the form fit (in the pull-out direction) between the latching nose 16 and the associated spring arm 17. The blocking elements 19 preferably take the form of flat plate-shaped or web-shaped projections whose front end engages behind the spring anus 17. Each secondary securing means preferably has two blocking elements 19 which, when the adapter 7, 10 is introduced into a plug place 6, 9, each secure a pair of the latching noses 16/spring arms 17.

Apart from securing the adapters 7, 10, the secondary securing means 18 also serve for securing or for fastening the plug connectors 8 or the mating plug connectors 11 in the adapters 7, 10. There is preferably provided for this purpose a form-fitting and/or force-fitting connection between the secondary securing means 18 and the associated adapter 7, 10 on the one hand and a form-fitting and/or force-fitting connection between the secondary securing means 18 and the associated plug connector 8 or the mating plug connector 11. For this purpose, as illustrated in the exemplary embodiment, the secondary securing means 18 can have, for example, a securing clamp 20 which is inserted through an opening into the associated adapter 7, 10 and embraces in a form-fitting manner the plug connector 8 or the mating plug connector 11 received in the adapter 7, 10. Furthermore, the secondary securing means 18 can be configured in such a way that it is inserted into the associated adapter 7, 10 in a form-fitting manner.

Figure 10:
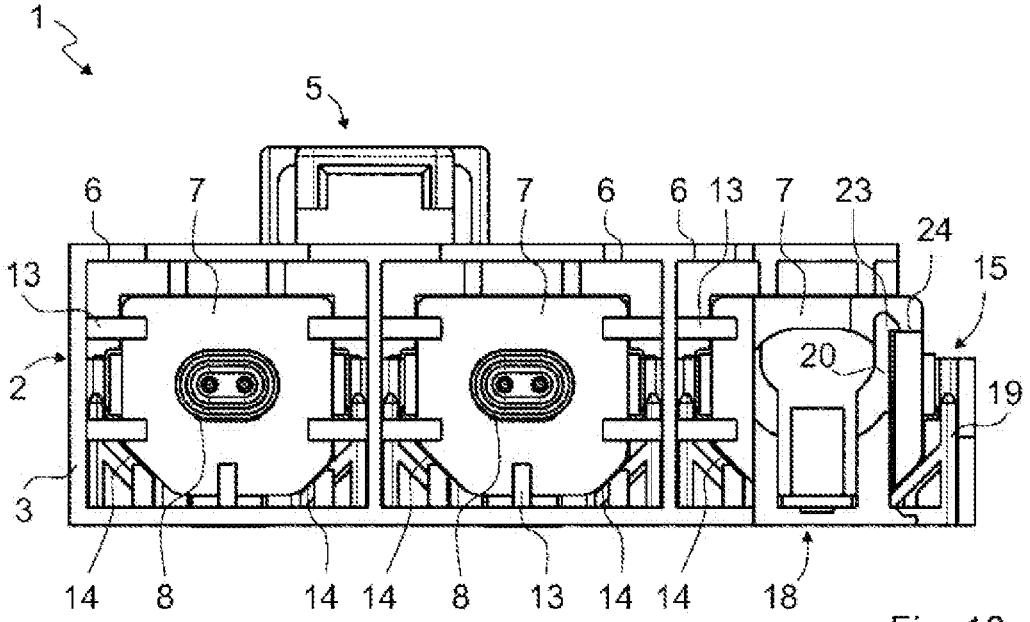
FIG. 10 schematically shows a front view of the first housing part with a partial section through one of the plug places to illustrate a secondary securing means in the end position in the plug place.

FIG. 8 and FIG. 10, in respect of which reference is made to the plug place 6 illustrated in section on the right in the drawing plane, illustrate a particularly advantageous embodiment for securing the secondary securing means 18 in the plugged-in end position. FIGS. 8 and 10 show a particularly advantageous end latching of the secondary securing means 18. The latching is preferably realized by virtue of the fact that the secondary securing means 18 has one, two or more latching elements 23. Preferably, only one latching element 23 is provided. The latching element 23 is preferably formed by virtue of the fact that the securing clamp 20 preferably has one, but possibly also more than one, snap hook 23.

The adapter 7, with which the secondary securing means 18 latches in the end position by means of the latching element, preferably the snap hook 23, has a corresponding latching receptacle 24. Here, the latching receptacle 24 can preferably take the form of a depression, groove or shoulder 24. The latching receptacle 24 is preferably formed in such a way that a form-fitting connection with the latching element 23 results in such a way that the form fit acts in the pull-out direction of the secondary securing means 18. This is correspondingly illustrated in FIG. 8 and FIG. 10.

If the secondary securing means 18 has more than one latching element 23, there is preferably also provided a corresponding number of latching receptacles 24.

Releasing of the snap hook 23 from the shoulder 24 can preferably be effected in the exemplary embodiment by virtue of the fact that a suitable tool, preferably a special tool, is inserted such that the form-fitting connection between the snap hook 23 and the shoulder 24 is released again.

As illustrated in FIG. 8 and FIG. 10, only one snap hook 23 is preferably formed on the securing clamp 20.

Although FIG. 10 shows the first housing part 3, the second housing part 4 or the second adapters 10 can be formed analogously.

The secondary securing means 18 is preferably configured in such a way that it can be plugged completely in its end position into the adapter 7, 10 only when both the adapter 7, 10 and the plug connector 8 or the mating plug connector 11 are situated in their predefined plug position (end position), that is to say in the assembly position. The secondary securing means 18 thus makes it possible to determine whether the adapters 7, 10 and the plug connectors 8 or the mating plug connectors 11 are correctly positioned. In the case of an incorrect position, the secondary securing means 18 cannot be plugged in up to its end position. This can preferably be achieved by the securing clamp 20 being configured in such a way that it can embrace the plug connector 8 or the mating plug connector 11 on the outside only when the securing clamp 20 strikes an outer region of the plug connector 8 or mating plug connector 11 that is suitably configured, preferably having a part-annular or annular depression, a groove, a recess, a taper 25 or a shoulder into which the securing clamp 20 can engage. This is illustrated in principle in FIGS. 5, 6 and 8.

The engagement preferably occurs in a form-fitting manner With further preference, there is provision here, as can be seen in particular from FIG. 8, that a form fit results at least in the pull-out direction such that the plug connector 8 (or analogously the mating plug connector 11) is prevented from being pulled out. Where appropriate, in addition or alternatively to the end stop 13, there can also be provided a form fit in the plug-in direction of the plug connector 8 (or analogously of the mating plug connector 11). In the exemplary embodiment, the plug connector 8 has a shoulder such that a taper 25 results. Alternatively, a form fit can also be produced in and counter to the plug-in direction, for example by means of a groove. FIG. 8 illustrates a stop region 26 by way of example to symbolize the form fit.

It is preferable that for each adapter type of the two adapter groups there is provided a corresponding secondary securing means 18.

The secondary securing means 18, the housing parts 3, 4 and/or the adapters 7, 10 are preferably formed in such a way that the secondary securing means 18 can assume at least two, preferably at least three, plug states along their plug-in direction C, wherein a first plug state relates to a basic position in which the secondary securing means 18 is captively connected to the housing part 3, 4 but not yet connected to the corresponding adapter 7, 10, and wherein a second plug state relates to a pre-latching position in which the secondary securing means 18 is connected to the corresponding adapter 7, 10 inside the housing part 3, 4, and wherein a third plug state relates to the end position in which the secondary securing means 18 is completely plugged into the housing part 3, 4.

In a particularly advantageous manner, as can be seen in the FIGS., the secondary securing means 18 channels axial forces acting on the plug connector 8/mating plug connector 11 into the associated housing part 3, 4. This is also achieved by the form-fitting connection of the secondary securing means 18 to the associated plug connector 8/mating plug connector 11 or the adapter 7, 10 and the form-fitting connection of the secondary securing means 18 to the associated housing part 3, 4.

As illustrated in the exemplary embodiment, the secondary securing means 18 can have plug-in preventers 21, wherein the plug-in preventers 21 can be designed to prevent two corresponding adapters 7, 10 from being plugged together when the secondary securing means 18 is not situated in its end position in the housing part 3, 4. The plug-in preventer 21 of the secondary securing means 18 preferably blocks the plugging together of the corresponding adapters 7, 10 of the plug connector 8 with a mating plug connector 11 when the secondary securing means 18 is situated in its pre-latching position.

The plug-in preventer 21 can be designed in such a way that, during the plugging-in of the secondary securing means 18, it is situated first of all in the displacement path of the adapter 10, 7 corresponding to the adapter 7, 10 assigned to the secondary securing means 18 and frees up the displacement path only in the completely plugged end state.

The interfaces, which are configured uniformly for the adapters 7, 10, are configured in such a way that they form at least one, preferably a plurality of, particularly preferably all, the interface(s) stated as follows: an interface for the primary securing means, for example the latching noses 16; an interface for the secondary securing means 18; an interface for guiding, for example a corresponding guide which interacts with the guide webs 12; an interface for the end stops 13; and an interface for positioning the adapters 7, 10 in as play-free a manner as possible in the plug places 6, 9 in the plug position, for which purpose the adapters 7, 10 preferably have a suitable external geometry.

Finally, there can be provision for the module housing 2 or its housing parts 3, 4 to be mechanically coded such that only housing parts 3, 4 of a common module housing type can be plugged one inside the other. Purely by way of example, a region 22 in which corresponding mechanical codings can be provided on the first housing part 3 is highlighted in FIG. 3 using dashed lines.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A securing system for plug connectors, said system comprising:

(a) a first adapter having a first adapter internal geometry for receiving a first plug connector;

(b) a second adapter having a second adapter internal geometry for receiving a second plug connector;

(c) a first housing part having at least one first plug place with a first plug place interface for receiving the first adapter;

(d) a second housing part having at least one second plug place with a second plug place interface for receiving the second adapter;

the first adapter having a first adapter outer side with a first adapter interface for positioning the first adapter in the first plug place; the first adapter outer side of the first adapter and the first plug place of the first housing part forming a first primary securing means for fastening the first adapter in the first plug place when the first adapter is inserted into a first predefined plug position in the first plug place; the second adapter having a second adapter outer side with a second adapter interface for positioning the second adapter in the second plug place; the second adapter outer side of the second adapter and the second plug place of the second housing part forming a second primary securing means for fastening the second adapter in the second plug place when the second adapter is inserted into a second predefined plug position in the second plug place;

(e) a first secondary securing means which can be plugged into the first housing part up and into a first predefined end position to fix the first plug connector in the first adapter when the first secondary securing means is in the first predefined end position; and (f) a second secondary securing means which can be plugged into the second housing part up and into a second predefined end position to secure the second plug connector in the second adapter when the second secondary securing means is in the second predefined end position.

2. A securing system as claimed in claim 1, wherein the first adapter plugs into the first housing part in a plug-in direction and the first secondary securing means plugs into the first housing part in a direction which is orthogonal to the plug-in direction.

3. A securing system as claimed in claim 1, wherein the first secondary securing means has a blocking element which blocks the first primary securing means in a locking state.

4. A securing system as claimed in claim 1, wherein the first secondary securing means has a plug-in preventer which prevents a connection between the first plug connector and the second plug connector when the first secondary securing means is plugged into the first housing part but is not in the first predefined end position.

5. A securing system as claimed in claim 1, wherein the first secondary securing means can assume at least two plug states, the at least two plug states including a state in which the first secondary securing means is at a first pre-latching position and is connected to the first adapter inside the first housing part, the at least two plug states further including a state in which the first secondary securing means is in the first predefined end position at which the first secondary securing means is completely plugged into the first housing part and fixes the first plug connector in the first adapter.

6. A securing system as claimed in claim 1, wherein the secondary securing means can assume at least three plug states, the at least three plug states including a state in which the first secondary securing means is at a first basic position at which the first secondary securing means is captively connected to the first housing part but is not connected to the first adapter, the at least three plug states further including a state in which the first secondary securing means is at a first pre-latching position and is connected to the first adapter inside the first housing part, the at least three plug states further including a state in which the first secondary securing means is at the first predefined end position at which the first secondary securing means is completely plugged into the first housing part and in which the first secondary securing means fixes the first plug connector in the first adapter.

7. A securing system as claimed in claim 4, wherein when the first secondary securing means is at the first pre-latching position the plug-in preventer is positioned to prevent the first plug connector from being plugged together with a corresponding second plug connector.

8. A securing system as claimed in claim 1, wherein when the first secondary securing means is in the first predefined end position, the first secondary securing means is connected to the first housing part in a form-fitting manner and is connected to the first adapter in a form-fitting manner to channel axial forces acting on the first plug connector to the first housing part via the first secondary securing means.

9. A securing system as claimed in claim 1, wherein the first secondary securing means embraces the first plug connector in the first adapter in an at least partially form-fitting manner.

10. A securing system as claimed in claim 2, wherein the first adapter includes a receptacle and wherein the first secondary securing means has a latching element which, when the first secondary securing means is in the first predetermined end position, latches the latching receptacle to prevent a movement of the first secondary securing means in a direction counter to the plug-in direction.

11. A securing system as claimed in claim 10, wherein the first secondary securing means includes one of: (i) a securing clamp, (ii) a snap connection, (iii) a receptacle and (iv) a partially circular spring element; and wherein the latching element is formed on at least one free end of: the securing clamp, the snap connection, the receptacle or the partially circular spring element.

12. A securing system as claimed in claim 1, wherein the first plug connector and the second plug connector are designed as at least one of: a plug, a coupling, a socket, a printed circuit board plug connector and a housing plug connector.

13. A securing system as claimed in claim 1, wherein the first plug place and the first adapter form a guide for guiding the first adapter into the first plug place.

14. A securing system as claimed in claim 1, wherein the first plug place has an axial end stop.

15. A securing system as claimed in claim 1, wherein the first primary securing means is formed by at least one latching nose and a spring arm.

16. A securing system as claimed in claim 1, wherein the first adapter and the first plug place are configured in such a way that plugging-in of the adapter is possible in only a single predetermined orientation.

17. A securing system as claimed in claim 1, wherein the first adapter is provided with a mechanical coding in such a way that only pairs of first plug connectors and second plug connectors which are functionally assigned to one another can be connected to one another.

18. A securing system as claimed in claim 1, wherein the second secondary securing means has a second plug-in preventer which prevents a connection between a first plug connector and a corresponding second plug connector when the first secondary securing means is plugged into the second housing part but is not in the second predefined end position.

19. A securing system as claimed in claim 1, wherein the second secondary securing means can assume at least two second plug states, the at least two second plug states including a state in which the second secondary securing means is at a second pre-latching position and is connected to the second adapter inside the second housing part, the at least two second plug states further including a state in which the second secondary securing means is in the second predefined end position at which the second secondary securing means is completely plugged into the second housing part and fixes the second plug connector in the second adapter.

20. A securing system as claimed in claim 2, wherein the second adapter plugs into the second housing part in the plug-in direction and the second secondary securing means plugs into the second housing part in the direction which is orthogonal to the plug-in direction.

21. A securing system as claimed in claim 3, wherein the second secondary securing means has a second blocking element which blocks the second primary securing means in a locking state.

22. A securing system as claimed in claim 6, wherein the second secondary securing means can assume at least three second plug states, the at least three second plug states including a state in which the second secondary securing means is at a second basic position at which second basic position the second secondary securing means is captively connected to the second housing part but is not connected to the second adapter, the at least three second plug states further including state in which the second secondary securing means is at a second pre-latching position and is connected to the second adapter inside the second housing part, the at least three second plug states further including a state in which the second secondary securing means is at the second predefined end position at which second secondary securing means is completely plugged into the second housing part and in which the second secondary securing means fixes the second plug connector in the second adapter.

23. A securing system as claimed in claim 9, wherein, when the first secondary securing means is in the first predefined end position, the first secondary securing means embraces the first adapter by one of: (i) a securing clamp, (ii) a snap connection, (iii) a receptacle and (iv) a partially circular spring element.

24. A securing system as claimed in claim 12, wherein the first plug connectors and the second plug connectors comprise housing plug connectors of at least one of the following types: HFM, H-MTD, AMEC, PL, BNC, TNC, SMBA, SMA, SMB, SMS, SMC, SMP, BMS, HSD, BMK, Mini-Coax and Makax.

25. A modular plug connector system for vehicles, comprising: a module housing having a first housing part having a plurality of uniform plug places with interfaces for respectively receiving a first adapter from a first adapter group, wherein the first adapter group comprises a plurality of first adapters of different type which have uniform interfaces on their outer sides for positioning in the plug places of the first housing part, and which have a different internal geometry for receiving differently configured plug connectors, and wherein the outer sides of the first adapters and the plug places of the first housing part are configured in such a way that they form a primary securing means for fastening the first adapter in the respective plug place when the first adapter is inserted into a predefined plug position in the plug place, and wherein the module housing comprises a second housing part having a plurality of uniform plug places with interfaces for respectively receiving a second adapter from a second adapter group, wherein the second adapter group comprises a plurality of second adapters of different type which have uniform interfaces on their outer sides for positioning in the plug places of the second housing part, and which have a different internal geometry for receiving differently configured mating plug connectors, and wherein the outer sides of the second adapters and the plug places of the second housing part are configured in such a way that they form a primary securing means for fastening the second adapter in the respective plug place when the second adapter is inserted into a predefined plug position in the plug place, wherein a securing system having secondary securing means is provided, wherein the secondary securing means can be plugged into the housing parts up and into a predefined end position, and wherein the secondary securing means are designed in the end position to secure the first adapters and the second adapters in the respective plug places, and the secondary securing means are further designed to secure the plug connectors in the first adapters and secure the mating plug connectors in the second adapters.

26. A modular plug connector system as claimed in claim 25, wherein the first housing part can be connected to the second housing part in order to connect the plug connectors received in the first housing part to the corresponding mating plug connectors received in the second housing part.

27. A modular plug connector system as claimed in claim 25, wherein the housing parts can be plugged one inside the other and can be latched with one another via at least one latching element pair.

28. A modular plug connector system as claimed in claim 25, wherein the first housing part has two or more rows of first plug places, the rows of first plug places being arranged parallel to one another and wherein the second housing part has two or more rows of second plug places, the rows of second plug places being arranged parallel to one another.

* * * * *